US010000319B2

(12) United States Patent
Pisarevsky

(10) Patent No.: US 10,000,319 B2
(45) Date of Patent: Jun. 19, 2018

(54) SEALABLE DRINKING CONTAINER WITH AIR-EXTRACTING MECHANISM FOR OXYGENATION SUPPRESSION

(71) Applicant: Arie Pisarevsky, Modiin (IL)

(72) Inventor: Arie Pisarevsky, Modiin (IL)

( * ) Notice: Subject to any disclaimer, the term of this patent is extended or adjusted under 35 U.S.C. 154(b) by 155 days.

(21) Appl. No.: 15/193,217

(22) Filed: Jun. 27, 2016

(65) Prior Publication Data

US 2017/0210523 A1 Jul. 27, 2017

Related U.S. Application Data

(60) Provisional application No. 62/281,259, filed on Jan. 21, 2016.

(51) Int. Cl.

| | |
|---|---|
| ***B65D 51/16*** | (2006.01) |
| ***A47G 19/22*** | (2006.01) |
| ***B65D 81/38*** | (2006.01) |
| ***B65D 47/12*** | (2006.01) |
| ***B65D 51/18*** | (2006.01) |

(52) U.S. Cl.

CPC ..... *B65D 51/1683* (2013.01); *A47G 19/2272* (2013.01); *B65D 47/12* (2013.01); *B65D 51/18* (2013.01); *B65D 81/3869* (2013.01); *B65D 2251/009* (2013.01); *B65D 2251/0025* (2013.01); *B65D 2251/0028* (2013.01); *B65D 2251/0087* (2013.01)

(58) Field of Classification Search

CPC ..... B65D 51/1683; B65D 51/1672; B65D 51/16; B65D 51/18; B65D 51/1616; B65D 51/1644; B65D 47/122; B65D 47/12; B65D 47/06; B65D 43/169; B65D 1/265; B65D 83/28; B65D 25/48; B65D 25/40; B65D 81/3869; B65D 81/3865; B65D 81/38; A47G 19/2272; A47G 19/2266; A47G 19/2205

USPC ..... 220/373, 62.18, 203.01, 203.29, 203.27, 220/203.23, 367.1, 715, 714, 713, 711, 220/592.17, 254.3, 254.2, 254.1; 141/65; 137/12.5; 222/568, 567, 566

See application file for complete search history.

(56) References Cited

U.S. PATENT DOCUMENTS

| | | | | |
|---|---|---|---|---|
| 1,601,705 A * | 9/1926 | Staunton | B67B 3/24 141/65 |
| 2,312,067 A * | 2/1943 | Bates | G01F 11/028 222/309 |
| 2,447,870 A * | 8/1948 | Polcyn | A47G 19/2272 215/309 |
| 2,729,354 A * | 1/1956 | Zepelovitch | B65D 51/145 215/342 |

(Continued)

*Primary Examiner* — Robert J Hicks

(74) *Attorney, Agent, or Firm* — Alphapatent Associates, Ltd; Daniel J. Swirsky

(57) ABSTRACT

A sealable drinking container for preserving the freshness, taste, nutrients and natural appearance of a smoothie/fruit and vegetable juice/green drinks, where a container body and an upper cap assembly have a sealable coupling mechanism forming the sealable drinking container and an air extracting device for extracting air from the sealable space, and where the air-extracting mechanism may be incorporated within an air-extracting chamber associated with the upper cap assembly and used with various types of containers.

20 Claims, 7 Drawing Sheets

(56) References Cited

U.S. PATENT DOCUMENTS

| | | | | |
|---|---|---|---|---|
| 3,520,102 | A * | 7/1970 | Henrion | B67B 7/06 53/381.4 |
| 3,672,114 | A * | 6/1972 | Sacks | B05B 11/3035 141/65 |
| 3,739,938 | A * | 6/1973 | Paz | A47G 19/2272 215/309 |
| 5,207,339 | A * | 5/1993 | Shyu | B65B 31/00 141/65 |
| 5,322,094 | A * | 6/1994 | Janesko | B65B 31/047 137/845 |
| 5,406,992 | A | 4/1995 | Miramon | |
| 5,456,380 | A | 10/1995 | Ito et al. | |
| 5,779,082 | A | 7/1998 | Miramon | |
| 6,352,166 | B1 * | 3/2002 | Copeland | B65D 47/20 215/387 |
| 6,375,024 | B1 | 4/2002 | Park | |
| 6,921,179 | B2 * | 7/2005 | Diak Ghanem | A47G 19/2227 206/217 |
| 2009/0065464 | A1 | 3/2009 | Cuocolo, Jr. | |
| 2009/0283533 | A1 | 11/2009 | Hemminger et al. | |
| 2010/0155429 | A1 | 6/2010 | Haimi | |
| 2012/0080456 | A1 * | 4/2012 | Steininger | A45F 3/18 222/531 |
| 2016/0114945 | A1 * | 4/2016 | Carsello | B65D 47/12 222/152 |

* cited by examiner

SEALABLE DRINKING CONTAINER WITH AIR-EXTRACTING MECHANISM FOR OXYGENATION SUPPRESSION

CROSS-REFERENCE TO RELATED APPLICATIONS

This application claims the benefit of priority from U.S. Provisional Patent Application No. 62/281,259, filed Jan. 21, 2016, the contents of which are incorporated by reference in their entirety.

FIELD OF THE INVENTION

The disclosure herein relates to a sealable drinking container. In particular, the disclosure relates to preserving the freshness, taste, nutrients and natural appearance of a smoothie or fruit/vegetable juice on the go, by using an air-extracting mechanism. The air-extracting mechanism is designed to use a sealable coupling mechanism to couple with a container body to form the sealable drinking container and further configured to extract air from the sealable space, thus operable as an oxygenation suppressing apparatus.

BACKGROUND OF THE INVENTION

Growing on their popularity because of their high nutritional values, freshness and good taste, fruits and vegetables based drinks (known as smoothies/green drinks/natural juices) are becoming increasingly widespread in the food industry.

Fresh fruit and vegetable are an important source of vitamins and minerals, but when they are processed, little remains of vitamins. For example in juices there are hardly any nutrients. Furthermore, industrially prepared smoothies are not as beneficial as the freshly made smoothies, as shown in various researches on this topic.

Industrially prepared and prepackaged smoothies are made from fresh fruit, but the mixture is already processed and made from concentrated fruit and vegetable juices and purees. Moreover, as the final product is commonly heat treated again, therefore there is hardly any more of vitamin C and vitamin B complex as well as other heat-sensitive secondary plant substances (such as antioxidants and polyphenols).

Freshly made smoothies are always a better choice over industrially prepared smoothies as the healthy ingredients are preserved. Storing a smoothie is preferable by many people to enable, as it may enable making a double batch and save time or facilitate taking a quality drink to work, office or for travelling. The main problem encountered is that oxygenation occurs naturally when your favorite fruits and vegetables are exposed to oxygen. Further, almost immediately beneficial nutrients and valuable enzymes start to diminish along with the fresh natural appearance and taste of your favorite smoothie.

There is a need for device that conveniently preserves the necessary healthier ingredients in a freshly made smoothie/green drink/vegetable or fruit juice for a longer duration, including vitamins and minerals so that a smoothie can be prepared in advanced for a later consumption.

The invention below addresses the above-described needs.

SUMMARY OF THE INVENTION

It is an advantage of the current disclosure that it may improve preserving freshness, taste, nutrients and natural appearance for healthy drinks such as a smoothie, vegetables/fruits juice, green drinks and the like, by using an integrated air-extracting device configured to couple using a sealable coupling mechanism with a container body, extracting air from the internal sealable space and further operable as an oxygenation suppressing apparatus. The disclosure described herein may provide a low cost reliable and easy-to-use solution for on-the-go users while travelling, at the office and the like.

Aspects of the disclosure present a sealable drinking container for preserving freshness and taste of a contained beverage in the sealable drinking container, said drinking container comprising: a container body; an upper cap assembly comprising a sealable outlet through which the contained beverage is drinkable, the sealable outlet having a drinking aperture sealable by a sealing element; a sealable coupling mechanism configured to attach the upper cap assembly with the container body to form a sealable drinking container having a sealable container space; and an air-extracting device comprising an activator and an extracting plunger, wherein the air-extracting device is operable to extract air from the sealable container space thereby suppressing oxygenation of the contained beverage therein, and the sealing element comprises an air tight seal configured to prevent leakage of air into the sealable container space.

As appropriate, the container body comprises a double wall having an inner wall and an outer wall configured to inhibit conduction of heat from the sealable container space.

Optionally, the container body comprises a double vacuum insulated wall having an inner wall and an outer wall forming a vacuum seal configured to inhibit conduction of heat from the sealable container space.

Optionally, the container body of the sealable drinking container comprises a wall of an opaque material.

Optionally, the container body of the sealable drinking container comprises a wall of a transparent material.

As appropriate, the upper cap assembly comprises an air-extracting chamber configured to incorporate the air-extracting device. Additionally, the air-extracting device further comprises a mechanical spring incorporated into the air-extracting chamber and attached to the extracting plunger.

As appropriate, the coupling mechanism is configured to couple the upper cap assembly having at least one female thread with the container body having at least one male thread.

As appropriate, the cap assembly further comprises a closure lid comprising the sealing element. The closure lid is further operable to allow air into the drinking aperture to facilitate drinking of the contained beverage.

Optionally, the upper cap assembly further comprises an air-inlet aperture and the closure lid comprising an air-inlet sealing element operable to seal the air-inlet aperture.

Optionally, the sealable outlet further comprises a lip to facilitate direct drinking therefrom.

Optionally, the sealable outlet further comprises a spout to facilitate pouring of the beverage therefrom.

Optionally, the drinking aperture of the sealable outlet is configured accommodate a drinking straw.

It is another aspect of the current disclosure to present an upper cap assembly providing access to a sealable drinking container for drinking a beverage, the upper cap assembly comprising: a sealable outlet having an drinking aperture and a sealing element; a sealable coupling mechanism configured to attach the upper cap assembly with a container body to form the sealable drinking container having a sealable container space; and wherein the upper cap assembly is further configured to preserve freshness and taste of the beverage contained in the sealable drinking container, the upper cap assembly further comprising: an air-extracting device operable to extract air from the sealable container space thereby suppressing oxygenation of the contained beverage therein; and the sealing element comprises an air-tight seal configured to prevent leakage of air into the sealable container space.

Accordingly, wherein the air-extracting apparatus comprises: an air-extracting mechanism; an upper cap body comprising an air-inlet aperture sealable by an air-inlet sealing element, an air-extracting chamber configured to incorporate the air-extracting mechanism; and a closure lid comprising the sealing element operable to cover tightly the drinking aperture of the sealable outlet, the closure lid is configured to lock onto the lip.

As appropriate, the upper cap assembly of further comprising a closure ring configured to lock the air-extracting mechanism into the air-extracting chamber. Additionally, the air-extracting mechanism further comprises a mechanical spring such that the activator is operable to activate the extracting plunger against the mechanical spring thereby generating linear motion to evacuate air from the sealable container space.

As appropriate, the closure lid comprises at least one hinge attached onto the upper cap body operable to enable the closure lid to turn over and uncover the drinking aperture of the sealable outlet allowing access of air thereby enabling drinking.

As appropriate, the closure lid comprises the air-inlet sealing element operable to cover tightly the air-inlet aperture, and further operable to disengage from the air-inlet aperture thereby uncovering the air-inlet aperture.

As appropriate, the coupling mechanism is configured to couple the upper cap assembly having at least one female thread with the container body having at least one male thread.

As appropriate, the seal of the sealing element is made of a rubberized material configured to fit into the drinking aperture of the sealable outlet.

As appropriate, the air-inlet sealing element is made of a rubberized material configured to fit into the air-inlet aperture.

As appropriate, the extracting plunger further comprises at least one rubberized sealing ring configured to prevent leakage of liquid into the air-extracting chamber.

BRIEF DESCRIPTION OF THE DRAWINGS

For a better understanding of the embodiments and to show how it may be carried into effect, reference will now be made, purely by way of example, to the accompanying drawings.

With specific reference now to the drawings in detail, it is stressed that the particulars shown are by way of example and for purposes of illustrative discussion of selected embodiments only, and are presented in the cause of providing what is believed to be the most useful and readily understood description of the principles and conceptual aspects. In this regard, no attempt is made to show structural details in more detail than is necessary for a fundamental understanding; the description taken with the drawings making apparent to those skilled in the art how the several selected embodiments may be put into practice. In the accompanying drawings.

DETAILED DESCRIPTION OF THE INVENTION

Figure 1:
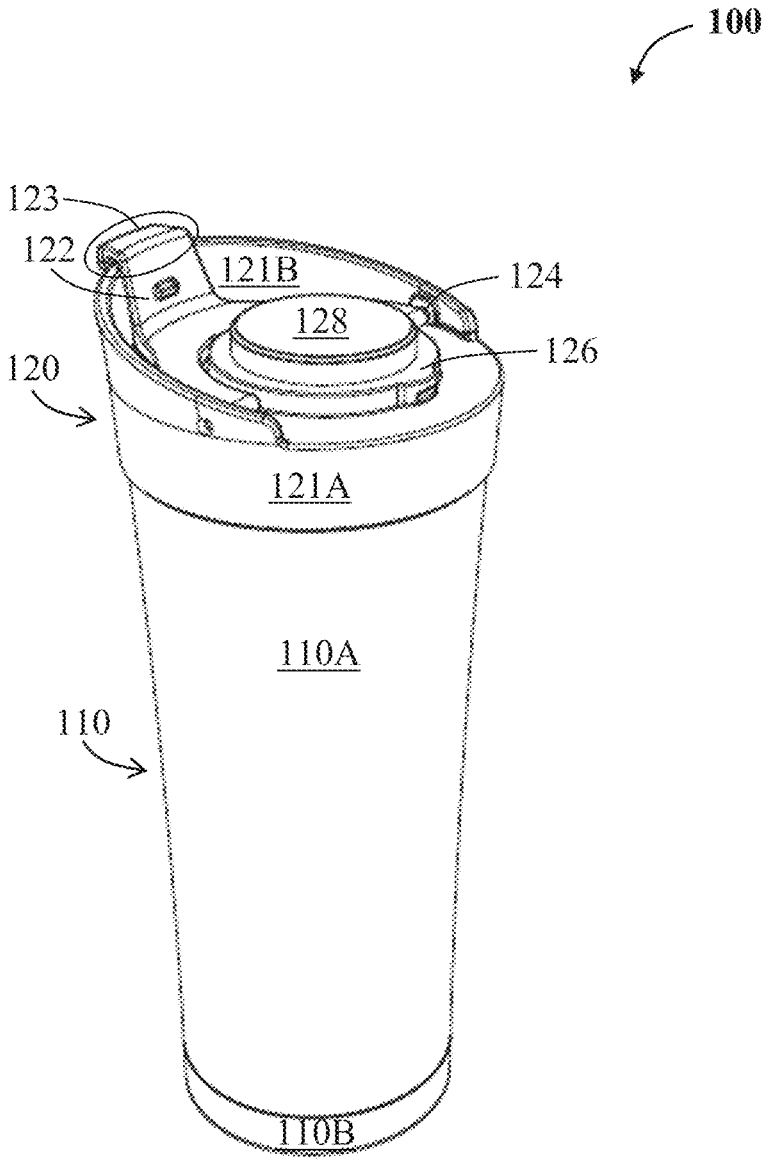
FIG. 1 is a schematic perspective view of a sealable drinking container for preserving the freshness and taste of fruits and/or vegetables beverages, according to one embodiment of the disclosure.

It is noted that the systems and methods of the invention herein, may not be limited in their application to the details of construction and the arrangement of the components or methods set forth in the following description or illustrated in the drawings and examples. The systems and methods of the invention may be capable of other embodiments or of being practiced or carried out in various ways.

Alternative methods and materials similar or equivalent to those described herein may be used in the practice or testing of embodiments of the disclosure. Nevertheless, particular methods and materials are described herein for illustrative purposes only. The materials, methods, and examples are not intended to be necessarily limiting.

Accordingly, various embodiments may omit, substitute, or add various procedures or components as appropriate. For instance, it should be appreciated that the methods may be performed in an order different than described, and that various steps may be added, omitted or combined. Also, aspects and components described with respect to certain embodiments may be combined in various other embodiments. It should also be appreciated that the systems, methods, devices, and software may individually or collectively be components of a larger system, wherein other procedures may take precedence over or otherwise modify their application.

The disclosure herein relates to a device associated with a sealable drinking container. In particular, the disclosure relates to preserving the freshness, taste, nutrients and natural appearance of one's favorite smoothie/green drink/vegetable or juice drink on the go, by using an air extraction mechanism configured to extract air from the interior of the beverage drinking container, thus operable as an oxygenation suppressing apparatus.

It is noted that the sealable drinking container may further be used with a variety of beverages such as coffee, tea and the like. Accordingly, the sealable drinking container is operable to keep the freshness, aroma and flavor as uniquely associated by its type.

As used herein, a smoothie is a thick blended beverage with shake like consistency, normally pureed in a blender containing fruits and/or vegetables as well as an added liquid such as fruit juice, vegetable juice, milk, water or even yogurt.

As used herein, rubberized material is a term used to describe any flexible, stretchable polymer coated textile or material. The coating on the material may be for various reasons including water resistance or waterproofing, or to impart non slip, grip or friction capabilities to the substrate fabric.

Reference is now made to FIG. 1, there is provided a schematic perspective view illustration of a sealable drinking container, which is generally indicated at 100, for preserving the freshness and taste of fruits and/or vegetables beverages (smoothies, green drinks and the like), according to one embodiment of the invention. The sealable drinking container 100 includes a container body 110 and an upper cap assembly 120 comprising an air-extracting device operable as an oxygenation suppressing apparatus.

The container body 110 includes a shaped container body component 110A and a bottom cap component 110B. The bottom cap component 110B is configured to attach to the shaped body component 110A, forming the container body 110. Alternatively, the container body 110 is made, using a mold or the like, combining the shaped container body component 110A and the bottom cap component 110B as one integrated unit. Additionally, the bottom cap component 110B may include a bottom horizontal unit or stands such as to allow putting the sealable drinking container 100 on a flat horizontal surface such as a table, a tray, a shelve and the like.

Optionally, the container body 110 comprises a double walled container as described in the embodiments of FIGS. 4A-B, hereinafter. Additionally or alternatively, the double walled container is made of opaque material. Alternatively, the double walled material is made of transparent material. As appropriate, the doubled wall material comprises insulating properties.

Optionally, the container body 110 comprises of a solid walled container as described in the embodiments of FIGS. 5A-B, hereinafter. Additionally or alternatively, the solid walled container is made of opaque material. Alternatively, the solid walled material is made of transparent material. As appropriate, the solid walled material comprises insulating properties.

Figure 2:
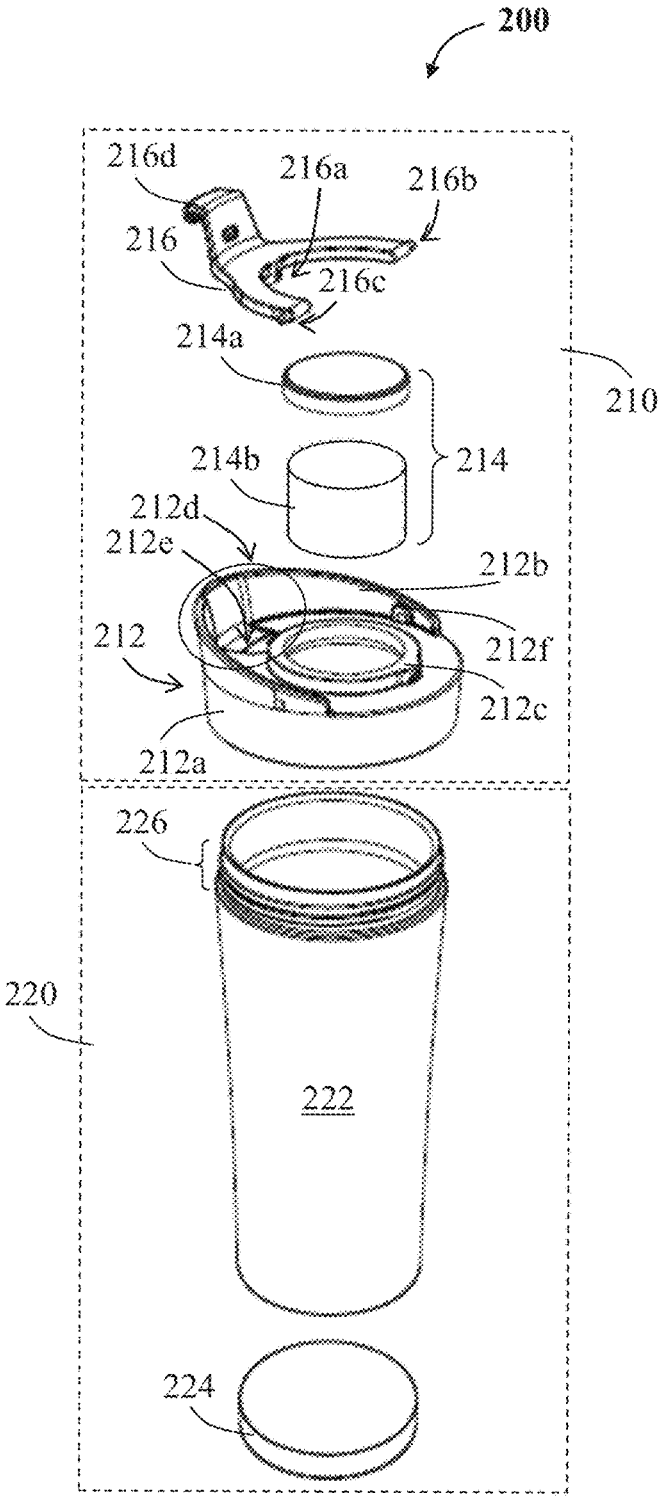
FIG. 2 is a schematic exploded perspective view of the main elements of a sealable drinking container, according to the embodiment of FIG. 1.

The upper cap assembly 120 includes an upper cap body 121A, an upper cap lip 121B and an air-extracting mechanism, operable to provide an air-tight liquid container, to extract air from within the container space and to suppress oxygenation of the beverage contained therein, keeping taste and freshness. The air-extracting mechanism includes an air plunger (not shown) operated by an activator 128, a closure ring 126 and a closure lid 122 rotatable over two hinges 124 and configured to be in a locked position in which the sealing element (not shown, beneath the closure lid 122) may seal tightly the drinking aperture (FIG. 2, item 212*e*). The closure lid 122 comprises a "U" shaped locking element 123 configured to lock the closure lid onto the lip 121B and provide a safe seal of the upper cap assembly 120. As appropriate, the closure ring 126 is configured to position securely the air-extracting mechanism onto the upper cap assembly 120.

It is noted that when the closure lid 122 is in open state, air is allowed into the container space through the drinking aperture (FIG. 2, item 212*e*) such that the beverage is drinkable.

It is noted that the schematic perspective view of the sealable drinking container 100 represent the sealable drinking container 100 in a closed position (ready for on-the-go) after extracting the air from the container space of the sealable drinking container 100 and the plunger activator 128 is in its lower position.

It is further noted that the shaped container body 110A, as represented in FIG. 1, is shown as a cylindrical container body, by way of example only. The shaped container body 110A may have other cross sectional shapes such as rectangular cross section, elliptical cross section, triangular cross section and various combinations.

Reference is now made to FIG. 2, there is provided a schematic exploded perspective view illustration of a sealable drinking container, which is generally indicated at 200, representing the main elements of the sealable drinking container 200, according to the embodiment of FIG. 1. The exploded view of the sealable drinking container 200 includes an upper cap assembly 210 comprising an air extraction mechanism, used as an oxygenation suppressing apparatus, and a container body 220.

The container body 220 includes a bottom cap component 224 attached to a container shaped body 222. Alternatively, the bottom cap component 224 is molded onto the container shaped body 222 to form an integrated unit of the container body 220. The shaped body 222 further comprises a coupling mechanism 226 configured to couple with the upper cap assembly 210 to form the air-tight sealable drinking container 200. The upper cap assembly 210 includes an upper cap body 212, an air extraction mechanism 214 and a closure lid 216.

As appropriate, the coupling mechanism 226 comprises at least one female thread configured to couple with the shaped body 222 having at least one male thread.

The upper cap body 212 includes an upper cap base element 212*a*, an upper cap lip 212*b*, a closure ring 212*c*, a sealable outlet 212*d* comprising a drinking aperture 212*e* to facilitate drinking or pouring the contained beverage and a hinge slot 212*f* (only one is shown).

As appropriate, the closure ring 212*c* is operable to secure the air-extracting mechanism 214 within the air-extracting chamber (not shown).

Optionally, the drinking aperture 212*e* of the sealable outlet 212*d* is further configured to accommodate a drinking straw when in open position, for example. Alternatively, the upper cap lip 212*b* of the sealable outlet facilitates direct drinking therefrom, when in open position. Additionally, the sealable outlet 212*d* may include a spout to facilitate pouring of the beverage therefrom, when in open position.

The air-extracting mechanism 214, used as an oxygenation suppressing apparatus, is operable to pump out the air contained within the space created between upper cap assembly 210 and the bottom cap component 224 of the container body 220. The air-extracting mechanism is configured to generate linear motion of the extraction plunger 214*b* by an activator 214*a*, activated manually by a user.

The closure lid 216 is operable to clip onto the upper cap lip 212*b* by a "U" shaped locking element 216*d* to tightly cover the drinking aperture 212*e* of the sealable outlet 212*d*, in a closed position. The closure lid 216 is further operable to change position to an open position, rotating over the hinges 216*b* and 216*c*.

As appropriate, to enable drinking, the "U" shaped locking element 216*d* needs to be flipped over to unlock the cover lid 216 from the upper cap lip 212*b* to allow air into the container space and facilitate drinking.

It is particularly noted that the closure lid 216 further comprises a sealing element (not shown, see FIG. 4A item 418) which further comprises an air-tight seal configured to prevent leakage of air into the sealable container space.

It is a feature of the current disclosure that the upper cap assembly 210 is an integrated unit incorporating the air-extracting mechanism 214 as an intrinsic component. Such an integrated unit is distinctive from a container from which air may be extracted with an external air-extracting mechanism unconnected to the upper cap.

In still other embodiments, where necessary the upper cap assembly may be adapted such that it may be readily dismantled by the user, possibly for cleaning or the like. In such an embodiment the intrinsic air-extracting mechanism 214 may be disassembled when necessary.

Additionally or alternatively, the air-extracting device may be a detachable component operable to be detached by the user, for example, without disengaging the cover lid in order to facilitate drinking.

Figure 3:
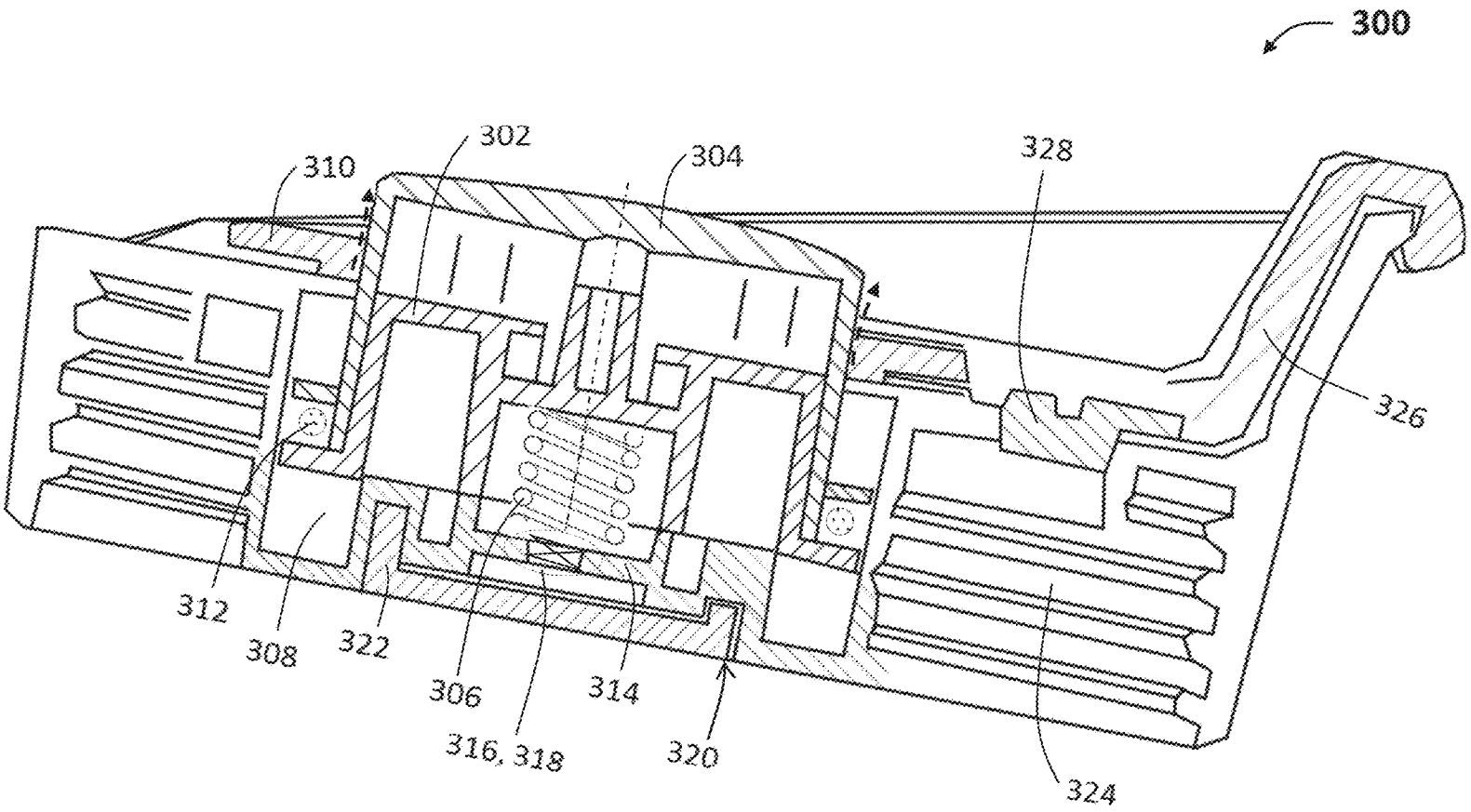
FIG. 3 is a schematic cross section illustration of the upper cap assembly and the air extraction mechanism, according to the an embodiment of the current disclosure.

Reference is now made to FIG. 3, there is provided a schematic cross section illustration of the upper cap assembly, which is generally indicated at 300, including the main elements of the air-extracting device, according to an embodiment of the current disclosure. The air-extracting device 300 is operable to extract air from a sealable container space (FIG. 2, item 222) thereby suppressing oxygenation of the contained beverage therein. The air-extracting device 300 includes an air-extracting mechanism comprising an extracting plunger 302, an activator 304 and a mechanical spring 306 incorporated into an air-extracting chamber 308.

The air-extracting chamber 308 includes a closure ring 310, a rubber sealing ring 312, an internal spring support 314, an aperture 316 cut through the internal spring support 314 and the bottom of the air-extracting chamber 308, and a non-returning valve 318 configured to fit into the aperture 316. The air-extracting chamber 308 further includes at its lower part at least one air-inlet hole 320 and a bottom cover 322. The mechanical spring 306 is positioned between the internal side of the extracting plunger 302 and the internal support 316 which may be attached to the air-extracting chamber 308.

Additionally, it is noted that the rubber sealing ring 312 is operable as another non-return valve to prevent air from the outside entering into the air-extracting chamber 308.

The air-extracting mechanism is operable to pump out the air from the sealable container space (FIG. 2, item 222) through the air-inlet holes 320 via the aperture 316 into the space of the air-extracting chamber 308 and pushed further, out through the circumference of the extracting plunger 304, as indicated by the dotted line.

It is noted that the non-returning valve is operable to allow one-directional air flow from the sealable container space (FIG. 2, item 222) into the space of the air-extracting chamber 308 only.

It is further noted that the bottom cover 322 is configured to cover the air-inlet holes 320 to avoid clogging of the air passage through the suction nozzle by fruit/vegetable blends.

It is noted that the schematic cross section illustration of the upper cap assembly further includes the sealable coupling mechanism 324, the closure lid 326 and the sealing element 328.

Figure 4A:
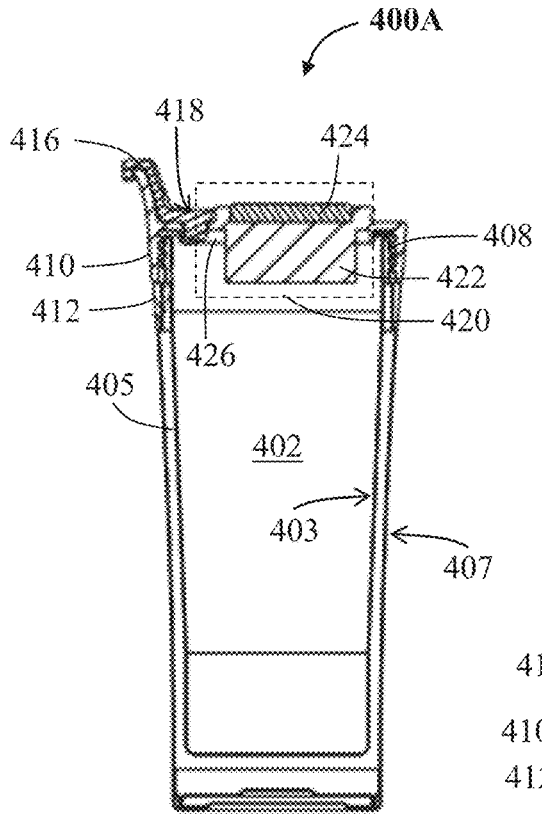
FIGS. 4A-B is a schematic front and side cross-section illustrations of a doubled walled sealable drinking container, according to another embodiment of the current disclosure.
Figure 4B:
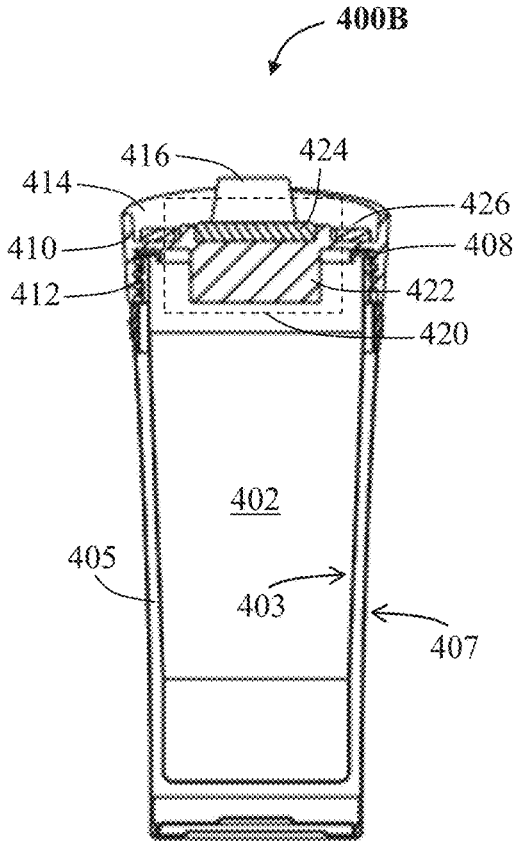

As illustrated in FIGS. 4A-B, there is provided a schematic side and front cross-section illustrations, which are generally indicated at 400A and 400B respectively, of a doubled walled sealable drinking container according to another embodiment of the current disclosure.

The doubled walled sealable drinking container, as shown in the cross section illustrations 400A and 400B includes an upper cap assembly 410 connectable to a container body 402 forming a sealable container space. The container body 402 comprising a double vacuum insulated wall having an inner wall 403 and an outer wall 407 forming a vacuum seal 405 configured to inhibit conduction of heat from the sealable container space.

As appropriate, the upper cap assembly 410 uses a sealable coupling mechanism 408 to couple with the container body 402 to ensure an air-tight assembly. Additionally, the doubled wall container body 402 may include a bottom cap molded the body container to form an integrated unit.

The upper cap assembly 410 includes an upper cap body comprising an upper cap base 412 and an upper cap lip 414, a closure lid 416 and an air-extracting mechanism 420 operable as an oxygenation suppressing apparatus.

The air extraction mechanism 420 includes a closure ring 426 and an air extraction plunger 422 operated by the activator 424 to enable pumping out air from the container internal space, to suppress oxygenation of the contained beverage. The closure lid 416 is shown in a closed position (air-tight), and is further operable to manually unlock by the user to facilitate drinking or pouring the beverage of the sealable drinking container space. Further, the closure lid 416 includes a sealing element 418 comprises an air-tight seal configured to prevent leakage of air into said sealable container space. The air-tight seal of the sealing element 418 is of rubberized material configured to fit into the drinking aperture (FIG. 2, item 212*e*) of the sealable outlet (FIG. 2, item 212*d*).

Figure 5A:
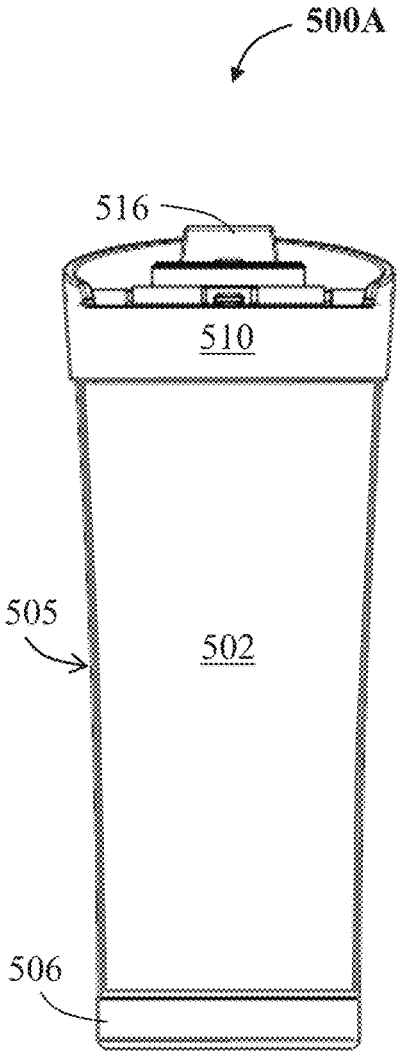
FIGS. 5A-B is a schematic rear and side view illustrations of an opaque walled sealable drinking container, according to one embodiment of the current disclosure.
Figure 5B:
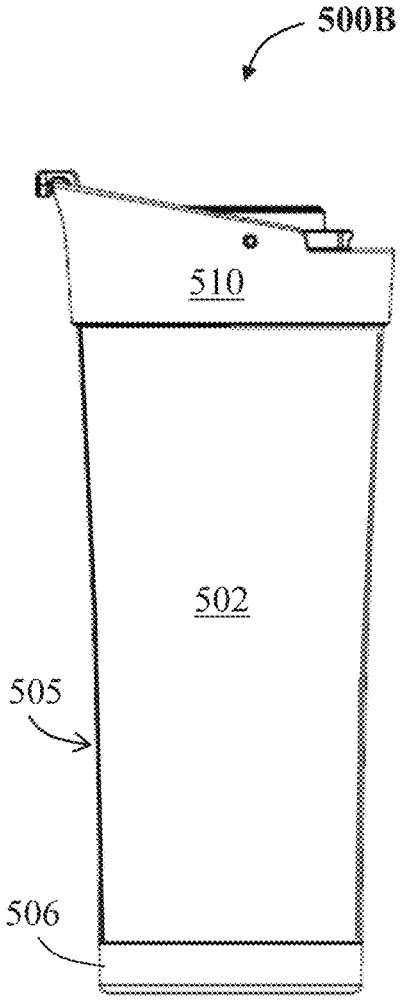

As illustrated in FIGS. 5A-B, there is provided a schematic rear and side views illustrations, which are generally indicated at 500A and 500B respectively, of an opaque walled sealable drinking container according to another embodiment of the current disclosure.

The opaque walled sealable drinking container, as shown in views 500A and 500B includes an upper cap assembly 510 connectable to a container body 502 of an opaque material 505. The bottom cap 506 is further attached to the container body 502, forming the space to contain the desired beverage.

Optionally, the opaque material serves as an insulating material to keep the taste and freshness of the contained beverage, such as smoothies, green drinks and the like.

It is noted that the opaque walled sealable drinking container is made of a solid material. Optionally, the opaque walled sealable drinking container is a made of doubled walled opaque material to gain a degree of insulation, thus keeping the freshness and nutrients of the desired drink for a longer period.

Figure 6:
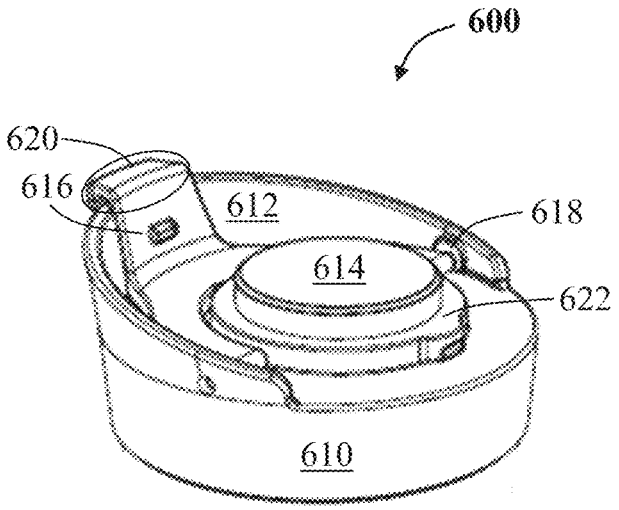
FIG. 6 is a schematic perspective view illustration of an upper cap assembly top view illustration of a sealable drinking container according to an embodiment of the current disclosure.

Reference is now made to FIG. 6, there is provided a schematic perspective view illustration, which is generally indicated at 600, of an upper cap assembly according to an embodiment of the current disclosure.

It is noted that upper cap assembly 600 includes a closure lid operable to cover tightly the drinking aperture of the sealable outlet, optionally using a seal of a rubberized material. The closure lid may have at least one hinge attached onto the upper cap body enabling the closure lid to rotate thereabout, disengaging from the drinking aperture of the sealable outlet and thereby uncovering the drinking aperture and allowing access to enable drinking.

The upper cap assembly perspective view 600 includes an upper cap body 610, an upper cap lip 612, an air-extracting activator 614 and a closure lid 616 rotatable over two hinges 618 and configured to be in a locked position in which the sealing element (not shown, beneath the closure lid 616) that may seal the drinking aperture (FIG. 2, item 212*e*).

The closure lid 616 comprises a "U" shaped locking element 620 configured to lock the closure lid 616 onto the upper cap lip 612 and provide a safe seal of the upper cap assembly 600. As appropriate, a closure ring 622 is configured to position securely an air-extracting mechanism (not shown) onto the upper cap body 610. The air-extracting mechanism is configured to extract air from within the container space created by coupling the upper cap assembly with a body container and to suppress oxygenation of the beverage contained therein. The air-extracting mechanism is operable by pressing the activator 614, possibly generating linear motion of an extraction plunger extracting the air. As appropriate, the closure ring 622 is configured to position securely the air-extracting mechanism onto the upper cap assembly body 610.

It is noted that the schematic perspective view of the upper cap assembly 600 is representing the closure lid 616 engaged (closed position) after extracting the air from the container space and the plunger activator 614 is in its lower position.

Figure 7:
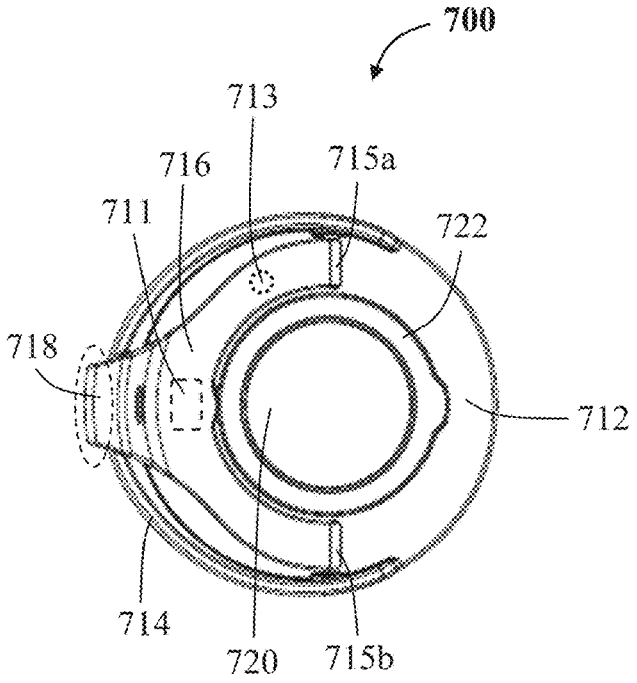
FIG. 7 is a schematic top view illustration of an upper cap assembly according to an embodiment of the current disclosure.

Reference is now made to FIG. 7, there is provided a schematic top view illustration, which is generally indicated at 700, of an upper cap assembly according to an embodiment of the current disclosure.

The top view illustration 700 of the upper cap assembly, provides the details of the upper cap assembly and includes the upper cap base element 712, the upper cap lip 714, the closure lid 716, the "U" shaped locking element 718, the activator 720 of the air extraction mechanism (FIG. 2, item 214) and the closure ring 722. The closure lid 716, shown in a closed position and clicked onto the upper cap lip 714 by the "U" shaped locking element 718.

The closure lid 716 is further operable to change position to an open position, rotating over the hinges 715*a* and 715*b*. When in open position, the drinking aperture (FIG. 2, item 212*e*) is exposed, this may allow air into the drinkable container to facilitate drinking or pouring the beverage of the container via the upper cap lip 714. The closure lid 716 further comprises a sealing element (not shown) to provide an air-tight container when the closure lid 716 is in closed position.

It is further noted, that the closure lid 616 provides sealing elements for the drinking aperture 711 and a sealing element for the air-inlet aperture 713. It is noted that the air-inlet aperture 713 is operable to provide an additional air passage into the drinking container to enable ease of drinking.

The closure ring 722 is operable to position the air-extracting mechanism in the associated air-extracting chamber (not shown) incorporating the extracting plunger and other associated elements of the mechanism.

It should be appreciated that the current embodiment, comprising the air-extracting mechanism is represented by way of example only, in a non-limiting manner. Other air-extracting mechanisms may exist operable to provide the same functionality.

Figure 8:
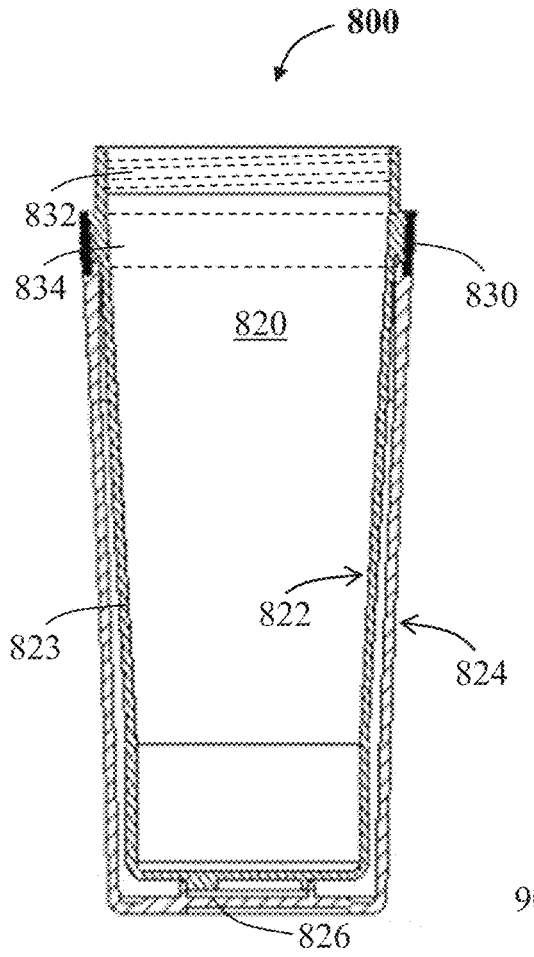
FIG. 8 is a schematic side cross-section illustration of a doubled walled container body according to an embodiment of the current disclosure.

Reference is now made to FIG. 8, there is provided a schematic side cross-section illustration, which is generally indicated at 800, of a doubled walled container body 802, according to an embodiment of the current disclosure. The illustration 800 includes a container 820 comprising a double vacuum insulated wall having an inner wall 822 and an outer wall 824 forming a vacuum seal 823 configured to inhibit conduction of heat from the sealable container space. The doubled walled container body 802 further comprises a double walled bottom element 826 forming an integrated unit. Additionally, the doubled walled container body 802 comprises a sealable coupling mechanism 832 operable to couple with an upper cap assembly to ensure an air-tight assembly such as described in FIG. 7, and further includes a rubber band 830.

Figure 9:
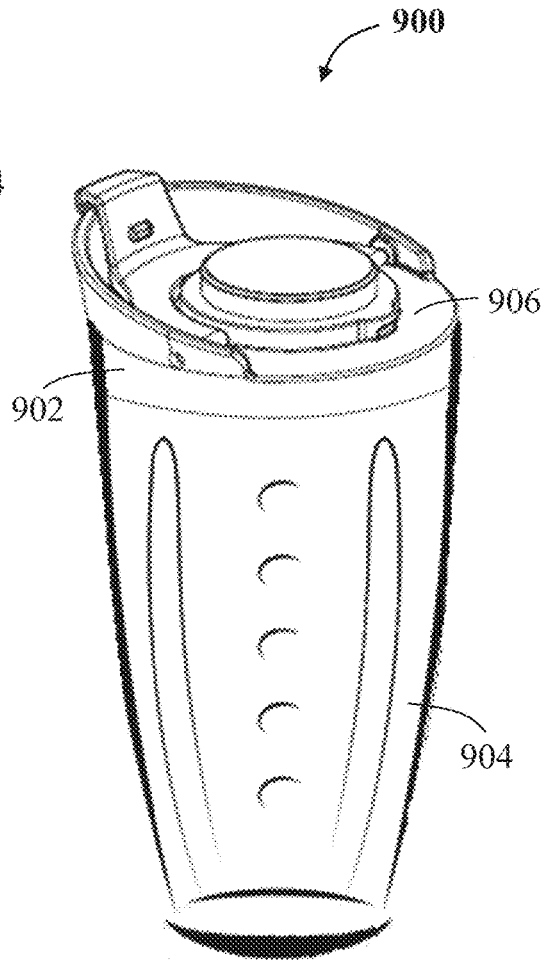
FIG. 9 is a schematic perspective illustration of an upper cap assembly coupled with an exemplified container body according to an embodiment of the current disclosure.

Reference is now made to FIG. 9, there is provided a schematic perspective illustration, which is generally indicated at 900, of an upper cap assembly coupled with an exemplified container body, according to an embodiment of the current disclosure.

According to the current disclosure, the upper cap assembly 902 may couple with various types of container bodies. For the sake of illustrative example only, the container body 904 is coupled by a sealable coupling mechanism 906 with the upper cap assembly 902. It is particularly noted that the exemplified container is just such an illustration and is presented in a non-limiting manner.

It should be appreciated to those skilled in the art that the invention may not be limited to the details of the foregoing illustrative embodiments and that the present invention may use various other embodiments in other specific forms without departing from the nature or essential attributes thereof. The present embodiments are therefore to be considered in all respects as illustrative and not restrictive.

Those skilled in the art to which this invention pertains will readily appreciate that numerous changes, variations and modifications can be made without departing from the scope of the invention mutatis mutandis.

Technical and scientific terms used herein should have the same meaning as commonly understood by one of ordinary skill in the art to which the disclosure pertains. Nevertheless, it is expected that during the life of a patent maturing from this application many relevant systems and methods will be developed. Accordingly, the scope of the terms such as computing unit, network, display, memory, server and the like are intended to include all such new technologies a priori.

The terms "comprises", "comprising", "includes", "including", "having" and their conjugates mean "including but not limited to" and indicate that the components listed are included, but not generally to the exclusion of other components. Such terms encompass the terms "consisting of" and "consisting essentially of".

The phrase "consisting essentially of" means that the composition or method may include additional ingredients and/or steps, but only if the additional ingredients and/or steps do not materially alter the basic and novel characteristics of the composition or method.

As used herein, the singular form "a", "an" and "the" may include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments or to exclude the incorporation of features from other embodiments.

The word "optionally" is used herein to mean "is provided in some embodiments and not provided in other embodiments". Any particular embodiment of the disclosure may include a plurality of "optional" features unless such features conflict.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween. It should be understood, therefore, that the description in range format is merely for convenience and brevity and should not be construed as an inflexible limitation on the scope of the disclosure. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6 as well as non-integral intermediate values. This applies regardless of the breadth of the range.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

Although the disclosure has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the disclosure.

The invention claimed is:

1. A sealable drinking container for preserving freshness and taste of a contained beverage therewithin, said drinking container comprising:

a container body;

an upper cap assembly comprising a sealable outlet through which the contained beverage is drinkable, said sealable outlet having a drinking aperture sealable by a sealing element;

a sealable coupling mechanism configured to secure the upper cap assembly to the container body to form a sealable container space; and an air-extracting device operable to extract air from said sealable container space, wherein said air-extracting device is operable to extract air from said sealable container space thereby suppressing oxygenation of the contained beverage therewithin, and said sealing element comprises an air-tight seal configured to prevent leakage of air into said sealable container space, and wherein said upper cap assembly comprises an air-extracting chamber configured to incorporate said air-extracting device, and said air-extracting device comprises an activator, an extracting plunger and a mechanical spring incorporated into the air-extracting chamber and attached to the extracting plunger.

2. The sealable drinking container of claim 1, wherein said container body comprises a double wall having an inner wall and an outer wall configured to inhibit conduction of heat from the sealable container space.

3. The sealable drinking container of claim 1, wherein said container body comprises a double vacuum insulated wall having an inner wall and an outer wall forming a vacuum seal configured to inhibit conduction of heat from the sealable container space.

4. The sealable drinking container of claim 1, wherein said container body comprises a wall of an opaque material.

5. The sealable drinking container of claim 1, wherein said container body comprises a transparent material.

6. The sealable drinking container of claim 1, wherein said upper cap assembly comprises a closure lid, said closure lid comprising said sealing element.

7. The sealable drinking container of claim 6, wherein said closure lid is operable to allow air into said drinking aperture to facilitate drinking of the contained beverage.

8. The sealable drinking container of claim 6, wherein said upper cap assembly further comprises an air-inlet aperture and said closure lid comprising an air-inlet sealing element operable to seal said air-inlet aperture.

9. The sealable drinking container of claim 1, wherein said sealable outlet further comprises a lip to facilitate direct drinking therefrom.

10. The sealable drinking container of claim 1, wherein said sealable outlet further comprises a spout to facilitate pouring of the beverage therefrom.

11. An upper cap assembly providing access to a sealable drinking container and facilitating drinking of a beverage contained therewithin, said upper cap assembly comprising:

a sealable outlet having a drinking aperture and a sealing element;

a sealable coupling mechanism configured to attach the upper cap assembly with a container body to form the sealable drinking container having a sealable container space; and wherein said upper cap assembly is further configured to preserve freshness and taste of the beverage contained in the sealable drinking container, said upper cap assembly further comprising:

an air-extracting device operable to extract air from said sealable container space thereby suppressing oxygenation of the contained beverage therein; and said sealing element comprises an air-tight seal configured to prevent leakage of air into said sealable container space; and wherein said air-extracting apparatus comprises:

an air-extracting mechanism;

an upper cap body comprising a lip and an air-inlet aperture sealable by an air-inlet sealing element;

an air-extracting chamber configured to incorporate said air-extracting mechanism; and a closure lid comprising said sealing element operable to cover tightly the drinking aperture of the sealable outlet, said closure lid configured to lock onto the lip, and wherein said air-extracting mechanism comprises an extracting plunger, an activator and a mechanical spring configured such that the activator is operable to activate the extracting plunger against the mechanical spring thereby generating linear motion to evacuate air from the sealable container space.

12. The upper cap assembly of claim 11, wherein said closure lid comprises said air-inlet sealing element operable to cover tightly the air-inlet aperture, and further operable to disengage from the air-inlet aperture thereby uncovering the air-inlet aperture.

13. The upper cap assembly of claim 11, wherein said coupling mechanism is configured to couple the upper cap assembly having at least one female thread with the container body having at least one male thread.

14. The upper cap assembly of claim 11, wherein said air-tight seal of the sealing element is made of a rubberized material configured to fit into the drinking aperture of the sealable outlet.

15. The upper cap assembly of claim 11, wherein said air-inlet sealing element is made of a rubberized material configured to fit into the air-inlet aperture.

16. An upper cap assembly providing access to a sealable drinking container and facilitating drinking of a beverage contained therewithin, said upper cap assembly comprising:

a sealable outlet having a drinking aperture and a sealing element;

a sealable coupling mechanism configured to attach the upper cap assembly with a container body to form the sealable drinking container having a sealable container space; and wherein said upper cap assembly is further configured to preserve freshness and taste of the beverage contained in the sealable drinking container, said upper cap assembly further comprising:

an air-extracting device operable to extract air from said sealable container space thereby suppressing oxygenation of the contained beverage therein; and said sealing element comprises an air-tight seal configured to prevent leakage of air into said sealable container space; and wherein said air-extracting apparatus comprises:

an air-extracting mechanism;

an upper cap body comprising a lip and an air-inlet aperture sealable by an air-inlet sealing element;

an air-extracting chamber configured to incorporate said air-extracting mechanism; and a closure lid comprising said sealing element operable to cover tightly the drinking aperture of the sealable outlet, said closure lid configured to lock onto the lip, and wherein said closure lid comprises said sealing element, said closure lid having at least one hinge attached onto said upper cap body enabling said closure lid to rotate thereabout, disengaging from the drinking aperture thereby uncovering the drinking aperture allowing air access to enable drinking.

17. The upper cap assembly of claim 16, wherein said closure lid comprises said air-inlet sealing element operable to cover tightly the air-inlet aperture, and further operable to disengage from the air-inlet aperture thereby uncovering the air-inlet aperture.

18. The upper cap assembly of claim 16, wherein said coupling mechanism is configured to couple the upper cap assembly having at least one female thread with the container body having at least one male thread.

19. The upper cap assembly of claim 16, wherein said air-tight seal of the sealing element is made of a rubberized material configured to fit into the drinking aperture of the sealable outlet.

20. The upper cap assembly of claim 16, wherein said air-inlet sealing element is made of a rubberized material configured to fit into the air-inlet aperture.

* * * * *